United States Patent [19]

Eylers

[11] Patent Number: 4,926,525

[45] Date of Patent: May 22, 1990

[54] ARRANGEMENT FOR FASTENING POCKET CLIPS TO TUBULAR PARTS OF WRITING INSTRUMENTS

[75] Inventor: Dieter Eylers, Idar-Oberstein, Fed. Rep. of Germany

[73] Assignee: Gottlieb Roll GmbH & Co., Idar-Oberstein, Fed. Rep. of Germany

[21] Appl. No.: 406,685

[22] Filed: Sep. 13, 1989

[30] Foreign Application Priority Data

Sep. 16, 1988 [DE] Fed. Rep. of Germany ..... 8811733

[51] Int. Cl.[5] ..... B43K 25/00

[52] U.S. Cl. ..... 24/11 F; 24/11 P; 24/3 J

[58] Field of Search ..... 401/213, 131; 24/10 R, 24/11 R, 11 FE, 11 PP, 11 P, 11 HC, 11 F, 11 CC, 3 L, 3 J

[56] References Cited

U.S. PATENT DOCUMENTS

| | | | |
|---|---|---|---|
| 1,111,469 | 9/1914 | Kraker | 24/11 F |
| 1,111,501 | 9/1914 | Scheible | 24/11 F |
| 1,622,316 | 3/1927 | Hanle | 24/11 F |
| 1,762,793 | 6/1930 | Oxx | 24/11 F |
| 1,783,736 | 12/1930 | Marshall | 24/11 F |
| 2,523,605 | 9/1950 | Welsh | 24/11 F |

FOREIGN PATENT DOCUMENTS

| | | | |
|---|---|---|---|
| 360918 | 11/1931 | Fed. Rep. of Germany | 24/11 F |
| 420164 | 11/1934 | United Kingdom | 24/11 F |

*Primary Examiner*—Richard J. Johnson

[57] ABSTRACT

A pocket clip stamped from metal strip material, fastened at its one end to the tubular part of a writing instrument and at its other end resiliently biased into contact with the tubular part, has at its fastening end two bent-back, tab-like material sections which reach through an opening into the interior of the tubular part. The tab-like material sections are curved at their free end portions situated inside of the tubular part, in a plane situated at right angles to the longitudinal central axis of the tubular part, with their concave sides facing one another, while their curved end portions engage with bias a locking component that is circular is cross section and is inserted from the open end into the tubular part. In an intermediate area still within the tubular part there is provided an open-ended slot in each of the tab-like material sections, enabling the curved end portions of the tab-like material sections to flex resiliently within the tubular part.

6 Claims, 1 Drawing Sheet

ARRANGEMENT FOR FASTENING POCKET CLIPS TO TUBULAR PARTS OF WRITING INSTRUMENTS

BACKGROUND OF THE INVENTION

The invention relates to an arrangement for fastening pocket clips to tubular parts of writing instruments such as ball-point pen casing parts, fountain pen caps or the like, wherein the pocket clip which has a tongue stamped from metal strip material and fastened at its upper end to the tubular part, the bottom end of the tongue being urged resiliently against the tubular part; at its upper end the clip has two tabs of material bent back from its opposite longitudinal margins toward the tubular part and pressed through a mating, substantially rectangular opening in the tubular part into the interior of the tubular part, where they are secured against complete withdrawal from the rectangular opening.

The fastening of pocket clips to casings of ball-point pens or to the caps of fountain pens was originally performed by means of a ring formed at the upper end of the clip and set at right angles to the tongue of the clip; this ring was held between two casing parts screwed, glued or otherwise joined together. The mounting of pocket clips on tubular casing parts, such as ball-point pen casings injection molded from plastic, was substantially simplified by providing at the upper end of the tongue a tab having lateral, rearwardly inclined tooth projections which are inserted into a complementary opening formed in the casing part and locked against withdrawal by the tooth projections penetrating into the plastic material. In the case of thin-walled tubular parts of metal, however, such fastening of the pocket clip is not possible.

U.S. Pat. No. 2,276,891 discloses a fastening arrangement in which the lug formed at the upper end of the tongue by prolonging its web portion is introduced through a slot in the tubular part and then bent downwardly onto the inner side of the wall of the tubular part. The lug is then affixed by means of additional lugs likewise brought through slots in the wall of the tubular part and bent across the tongue. The lugs serve exclusively to produce a very rigid fastening of the pocket clip to the tubular part. The resilient holding force must therefore be assured by making the clip appropriately spring-elastic. At the same time, however, the pocket clip itself must be sufficiently stable so that it cannot be accidentally overstretched to such an extent that its pocket-holding end no longer springs back against the tubular part of the writing instrument. Consequently, either a relatively thick sheet-metal material must be used in making the pocket clip, or it must be made sufficiently resistant to permanent deformation by appropriately shaping its cross section. This, however, necessarily makes the spring force urging the pocket-holding end of the clip against the tubular part of the writing instrument high, which does assure that the writing instrument will be held tightly and securely in a pocket or the like, but at the same time makes it inconvenient to use and can also do damage to portions of garments gripped between the tongue and the tubular casing part.

The invention, on the other hand, is addressed to the problem of creating an arrangement for fastening pocket clips to tubular parts of writing instruments which can consist either of plastic or of thin metallic material, which will permit a quick and easy fastening of the previously made pocket clip with a relatively stiff tongue, i.e., one not resiliently flexible to a sufficient degree, to an associated tubular part, while the gripping force produced between the tongue and the tubular part is to be low in comparison, so that the free, clasping end of the tongue can easily be slipped over the outer margin of the pocket when the writing instrument is inserted into the pocket of a garment.

SUMMARY OF THE INVENTION

Setting out from a fastening arrangement of the kind mentioned above, this problem is solved by the invention by the fact that tab-like sections of the material are curved arcuately and oppositely in a plane at right angles to the longitudinal central axis of the tubular part, with their concave sides facing one another at their free end areas situated inside of the tubular part; that the curved end portions of the tab-like sections of the material engage with bias a locking component of circular cross section inserted from the open end into the tubular part, and that in an area of each of the tab-like sections of material, between the curved ends and the external tongue but still inside of the tubular portion, a slot is provided which is open at its bottom end and disposed substantially parallel to the tongue, these slots permitting the curved end portions of the tab-like sections of material adjoining the slot to flex resiliently within the tubular part. To install the pocket clip on the corresponding tubular part, therefore, it is necessary merely to pass the curved end portions of the tab-like material sections through the rectangular opening in the tubular part, and then push the locking component from the open end of the tubular part between the curved end portions. The slotting of the tab-like sections of material makes the end portions grasping the locking component easily flexible, i.e., when the free gripping end of the relatively stiff clip tongue is lifted, the tab-like sections of material in contact with the locking component are tilted and resiliently spread apart. The resilient deformation of the sections of material therefore makes available the necessary and desirable, relatively light spring action, while the expansion of the material sections within the tubular part simultaneously assures that the clip cannot escape through the rectangular opening, since the width of the opening is such as to admit only the unexpanded tab-like material sections.

In a preferred further development of the invention, the locking section of the locking component, which is resiliently clasped by the arcuate end portions of the tab-like material sections, has a diameter which is smaller than the inside diameter of the tubular part, and the locking section is adjoined, toward the open end of the tubular part, by a mounting section of a larger diameter substantially equal to the inside diameter of the tubular part. The mounting section thus holds the locking section centered in the tubular part.

Although the locking component is already held by the end portions of the tab-like material sections resiliently clasping it, it is recommendable to secure it additionally against escape from the tubular part by making the outside diameter of its mounting section such that it is held by a press fit in the tubular part when in the proper locking position.

The locking component itself is best made hollow, and it is also open at its extremity adjacent the open end of the tubular part of the writing instrument, so as not interfere with the introduction of a cartridge for a ballpoint pen or the spring of a fountain pen or the tip of a fiber- or ball-point pen.

The locking component is preferably made by pressing from sheet metal, permitting great strength with small wall thickness plus easy and quick manufacture.

At its free end remote from the mounting section the locking section of the locking component can best have a circumferential chamfer to center the locking section between the curved end portions of the tab-like material sections when inserted into the tubular part, and spread them apart as its insertion continues, until they resiliently clasp the locking section in the final locking position.

DESCRIPTION OF THE DRAWINGS

The invention will be further explained in the following description of an embodiment, in conjunction with the drawing wherein.

DESCRIPTION OF THE PREFERRED EMBODIMENT

Figure 1:
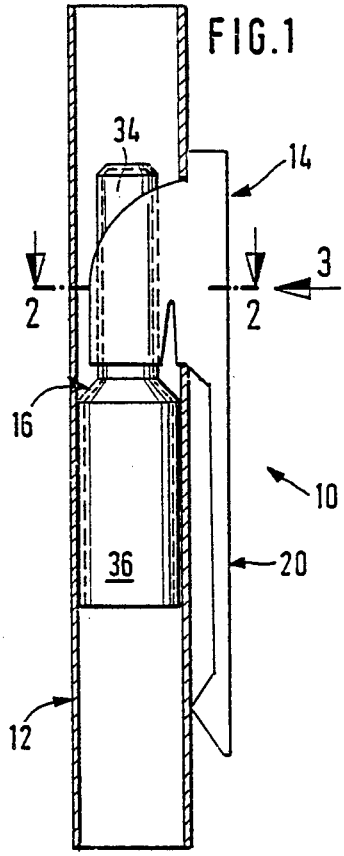
FIG. 1 shows a fastening arrangement in accordance with the invention, partially in a longitudinal central section and partially in a side view.
Figure 3:
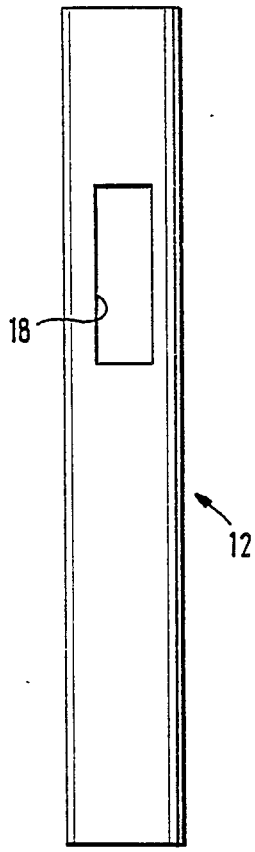
FIG. 3 is a frontal view of the tubular part of the fastening arrangement viewed in the direction of arrow 3 in FIG. 1.
Figure 4:
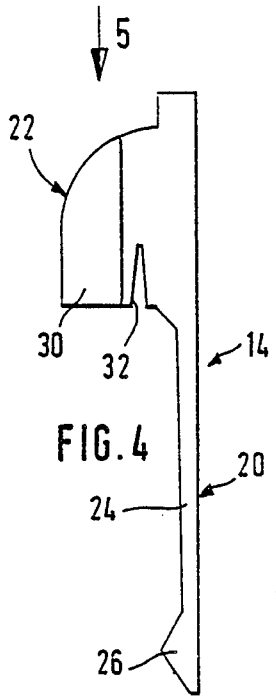
FIG. 4 is a side view of the pocket clip to be fastened to the tubular part shown in FIG. 3.
Figure 2:
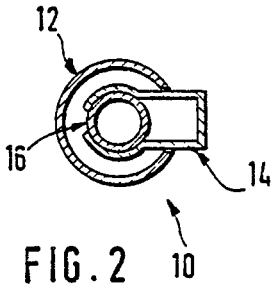
FIG. 2 is a cross section viewed in the direction of arrows 2—2 in FIG. 1.
Figure 5:
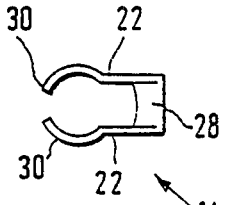
FIG. 5 is a view of the pocket clip seen in the direction of arrow 5 in FIG. 4.
Figure 6:
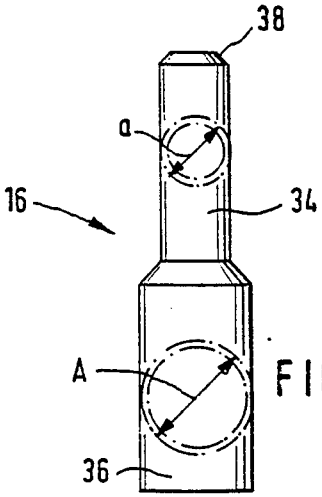
FIG. 6 is a side view of the locking component anchoring the pocket clip on the inside of the tubular part.

The fastening arrangement shown in FIGS. 1 and 2 and identified as a whole by the number 10, consists of a total of three parts, namely the tubular part 12 shown separately in FIG. 3, which in the illustrated case is a tubular sheet-metal part of the casing of a ball-point pen, the pocket clip 14 which is represented in detail in FIGS. 4 and 5 and is to be fastened to the tubular part 12, and the locking component 16 (FIG. 6) holding the pocket clip 14 at its upper end, in FIGS. 1 and 4, within the tubular part 12.

In the area in which the pocket clip 14 is fastened, the tubular part 12 has a window-like opening 18 of rectangular shape in plan, through which two tab-like sections 22 bent from the lateral margins of the actual tongue 20 of the pocket clip stamped and pressed from sheet metal can be inserted into the interior. The tab-like material sections 22 are continued on the side adjacent the tongue toward the bottom and top end of the tongue in the form of narrower stiffening flanges 24 of material which are widened at 26 at the bottom end of the tongue 20 and together with a prolonged and backwardly bent section of the web portion of the tongue form the so-called bead. At the upper end the space between the flanges 24 is also filled by a prolonged section 28 (FIG. 5) bent back over the lateral flanges.

The tab-like material sections 22 have a height that is but slightly smaller than the height of the window-like opening 18. When the pocket clip 14 is installed in its proper position on the tubular part, the free end portions of the tab-like material sections 22 inside of the tubular part 12 are, in the manner seen in FIG. 5, arcuately curved at 30 such that their confronting concave inside surfaces form portions of a circle. The curved end portions 30 are partially cut free by a slot 32 running upward from the bottom edge of the tab-like material sections 22 over a portion of the height of the latter, so that the lower, cut-free portion of the tab-like material sections can expand resiliently.

The mounting of the tab-like material sections 22 within the tubular part 12 in the proper fastening position represented in FIG. 1, is accomplished by means of the locking component 16 (FIG. 6) which, in the case represented, is a hollow piece stamped and pressed from relatively thin sheet metal, and has virtually two successive sections 34 and 36 of circular cross section and different diameters. The upper section 34 has an outside diameter a which is slightly larger than the diameter of the circle defined by the inside surfaces of the end portions 30 of the tab-like material sections 22, so that the curved end portions 30 resiliently clasp section 34 of the locking component 16 when the latter is in the fastening position. The bottom section 36 of the locking component 16, however, has an outside diameter A which is slightly oversize in relation to the inside diameter of the tubular part 12, so that section 36 is held with a press fit inside of the tubular part 12. The bottom end of section 36 of the locking component 16 remote from section 34 is open, so that parts of the mechanism of the writing instrument, e.g., the cartridge of a ball-point pen, can be inserted all the way into the interior of the locking component 16.

At the free end portion remote from section 36, the upper section 34 of the locking component is closed, and also has a circumferential chamfer 38 which simplifies the insertion of this end between the tab-like material sections 22 when the pocket clip 14 is installed on the tubular part 12, inasmuch as the chamfer 38 forces apart the tab-like material sections 22 when the locking component 16 is inserted, as soon as its leading end enters between the tab-like material sections 22.

The fastening arrangement described above permits a resilient rocking up of the bottom end bearing the bead of the tongue 20 which is made relatively stiff by the lateral flanges 24, while the curved end portions 30 of the tab-like material sections 22 clasping with spring bias section 34 of the locking component are positively spread apart. The spring bias holding the tongue 20 against the tubular part 12 is thus produced, not by a resilient flexing of the tongue 20 but by the expansion of the tab-like material sections 22. The rocking up of the bottom portion of the tongue 20 can be continued until the edge of the tab-like material sections 22 formed at the bottom end of the slot 32 abut against the inside surface of the tubular part 12. Since the tab-like material sections 22 are positively spread apart in this raised position, the assurance is provided that the said edge will not escape through the window-like opening 18 but will abut against the inner surface of the tubular part 12 beside the opening 18. Disassembly of the pocket clip 14 will thus not be possible until first the locking component 16 is drawn far enough out of its proper fastening position for the tab-like material sections 22 come free of section 34 of the locking component 16.

It is apparent that modifications and further developments of the embodiment can be achieved within the scope of the idea of the invention which will relate, for example, to the materials used in making the tubular part 12 and the locking component 16. In the embodiment described the two above-mentioned parts are made from sheet metal, yet it is evident that there is nothing against making them of plastic.

What is claimed is:

1. In combination:

a tubular part of a writing instrument, such as a ballpoint pen casing, fountain pen cap or the like, said tubular part having a substantially rectangular opening in a circumferential wall thereof, and having an open end; a pocket clip having a tongue stamped from metal band material and made relatively stiff with an upper end flexibly fastened to the tubular part and a lower end urged resiliently against the tubular part, said upper end having two tab-like material sections passed through the substantially rectangular opening into the interior of the tubular part having free end portions lying in the interior of the tubular part, the tab-like material sections being bent arcuately contrariwise with concave sides facing one another in a plane at right angles to the longitudinal central axis of the tubular part; and a locking component circular in diameter and inserted into the tubular part from the open end, said bent end portions engaging with bias the locking component and permitting a resilient rocking up of the bottom end of the tongue, in an intermediate area each tab-like material section having a slot open at a lower end and running substantially parallel to the pocket clip, for permitting a resilient springing open of the end portions of the tab-like material sections adjoining the slots, within the tubular part.

2. The combination of claim 1, wherein the locking component has a locking section which is resiliently clasped by the arcuate end portions of the tab-like material sections and which has a diameter which is smaller than the free inside diameter of the tubular part, the locking section being adjoined toward the open end of the tubular part by a mounting section having an outside diameter substantially equal to the free inside diameter of the tubular part.

3. The combination of claim 1, wherein the outside diameter of the mounting section of the locking component is so dimensioned that it is held by a press fit in the tubular part.

4. The combination of claim 1, wherein the mounting section of the locking component is hollow and has an open end for receiving a writing instrument.

5. The combination of claim 4, wherein the locking component is a piece pressed from sheet metal.

6. The combination of claim 2, wherein the locking section of the locking component has a circumferential, conical bevel at an end remote from the mounting section.

* * * * *